US005128720A

United States Patent [19]

Creveling

[11] Patent Number: 5,128,720

[45] Date of Patent: Jul. 7, 1992

[54] DEVICE FOR COLLECTING CONTAMINATION PRODUCTS AND OZONE FROM A CORONA CHARGER

[75] Inventor: Clyde M. Creveling, Rochester, N.Y.

[73] Assignee: Eastman Kodak Company, Rochester, N.Y.

[21] Appl. No.: 643,593

[22] Filed: Jan. 18, 1991

[51] Int. Cl.[5] ..... G03G 21/00

[52] U.S. Cl. ..... 355/215; 355/219; 355/221

[58] Field of Search ..... 355/215, 219, 221; 55/387, 467, 472; 250/324-326; 361/225

[56] References Cited

U.S. PATENT DOCUMENTS

| | | | |
|---|---|---|---|
| Re. 30,897 | 4/1982 | Yamamoto et al. | 355/21 D |
| 3,862,420 | 1/1975 | Banks et al. | 250/324 |
| 3,936,184 | 2/1976 | Tanaka et al. | 355/215 |
| 4,026,701 | 5/1977 | Till et al. | 96/1 R |
| 4,105,444 | 8/1978 | Shinohara et al. | 96/1 R |
| 4,143,118 | 3/1979 | Laing | 423/210 |
| 4,745,282 | 5/1988 | Tagawa et al. | 355/221 |
| 4,922,303 | 5/1990 | Takeda et al. | 355/221 X |
| 5,018,045 | 5/1991 | Myochin et al. | 355/215 X |

FOREIGN PATENT DOCUMENTS

| | | | |
|---|---|---|---|
| 0000681 | 1/1982 | Japan | 355/219 |
| 0159672 | 7/1986 | Japan | 355/215 |
| 0213868 | 9/1986 | Japan | 355/221 |
| 0235867 | 10/1986 | Japan | 355/215 |
| 0127269 | 5/1988 | Japan | 355/219 |
| 7502441 | 5/1975 | Netherlands | 355/221 |

OTHER PUBLICATIONS

Harpavat et al., Xerox Disclosure Journal, vol. 1, no. 3, Mar. 1976, p. 57.

*Primary Examiner*—Grimley A. T.
*Assistant Examiner*—William J. Royer
*Attorney, Agent, or Firm*—Lawrence P. Kessler

[57] ABSTRACT

In an electrostatographic reproduction apparatus employing at least one corona charger having an elongated shell and at least one corona wire running in the longitudinal direction within the walls of the charger shell, a device for collecting contamination products and harmful gasses from the corona charger. The collection device comprises a duct located within the shell of the charger closely adjacent to the walls thereof, the duct defining a series of ports spaced along the duct in the longitudinal direction of the charger shell. A flow of air into the duct is provided to directly collect harmful gasses produced by the corona charger and collect contamination products from the environment within the reproduction apparatus without allowing such contamination products to contact and contaminate the corona wire or shell.

7 Claims, 2 Drawing Sheets

DEVICE FOR COLLECTING CONTAMINATION PRODUCTS AND OZONE FROM A CORONA CHARGER

BACKGROUND OF THE INVENTION

This invention relates in general to electrostatographic reproduction apparatus employing corona chargers, and more particularly to a device for collecting contamination products and ozone from a corona charger of an electrostatographic reproduction apparatus.

In modern high speed/high quality electrostatographic reproduction apparatus (copier/duplicators or printers), a latent image charge pattern is formed on a uniformly charged dielectric support member. Pigmented marking particles are attracted to the latent image charge pattern to develop such image on the support. The dielectric support is then brought into contact with a receiver member and an electric field applied to transfer the marking particle developed image to the receive member from the dielectric support. After transfer, the receiver member bearing the transferred image is transported away from the dielectric support and the image is fixed to the receiver member by heat and/or pressure to form a permanent reproduction thereon.

In certain process steps for the electrostatographic reproduction apparatus, such as for example uniformly charging the dielectric support, detacking the receiver member from the dielectric support, or cleaning the dielectric support, it is common practice to employ corona chargers. However, corona chargers have a tendency to produce harmful gases such as ozone and nitrogen oxides. The adverse effects of ozone on equipment and humans has been well established. The need for control of the ozone emissions is especially critical in the area of consumer products such as reproduction apparatus since the operator is usually unaware of the hazards. Further, nitrogen oxides have been shown to be deliterious to dielectric supports causing undesirable image defects in the copies being reproduced by the reproduction apparatus.

Devices have been proposed for removing corona charger generated harmful gasses from electrostatographic reproduction apparatus (see for example U.S. Pat. Nos. RE 30,897, reissued Apr. 6, 1982, in the names of Yamamoto et al, and 4,143,118, issued Mar. 6, 1979, in the name of Laing). Such devices are relatively large, and have not been designed to be completely effective for their intended function. That is, they tend to draw additional contaminants from inside the reproduction apparatus into the charger where such contaminants can contaminate the charger. Further, in modern reproduction apparatus where space within the apparatus housing is at a premium, it may not be possible to economically employ such devices. In order to overcome space limitations, a unique environmental control apparatus of compact configuration is described in U.S. patent application No. 625,190, filed Dec. 10, 1990, in the name of Creveling.

SUMMARY OF THE INVENTION

This invention is directed to a device, suitable for use with the environmental control apparatus of the aforementioned U.S. patent application No. 625,190, for collecting contamination products and ozone from a corona charger of an electrostatographic reproduction apparatus. The contamination collection device according to this invention comprises a duct located within the shell of the charger closely adjacent to the walls thereof, the duct defining a series of ports spaced along the duct in the longitudinal direction of the charger shell. A flow of air into the duct is provided to directly collect harmful gasses produced by the corona charger and collect contamination products from the environment within the reproductions apparatus without allowing such contamination products to contact and contaminate the corona wire or shell.

The invention, and its objects and advantages, will become more apparent in the detailed description of the preferred embodiment presented below.

BRIEF DESCRIPTION OF THE DRAWINGS

In the detailed description of the preferred embodiment of the invention presented below, reference is made to the accompanying drawings, in which.

DESCRIPTION OF THE PREFERRED EMBODIMENT

Figure 1:
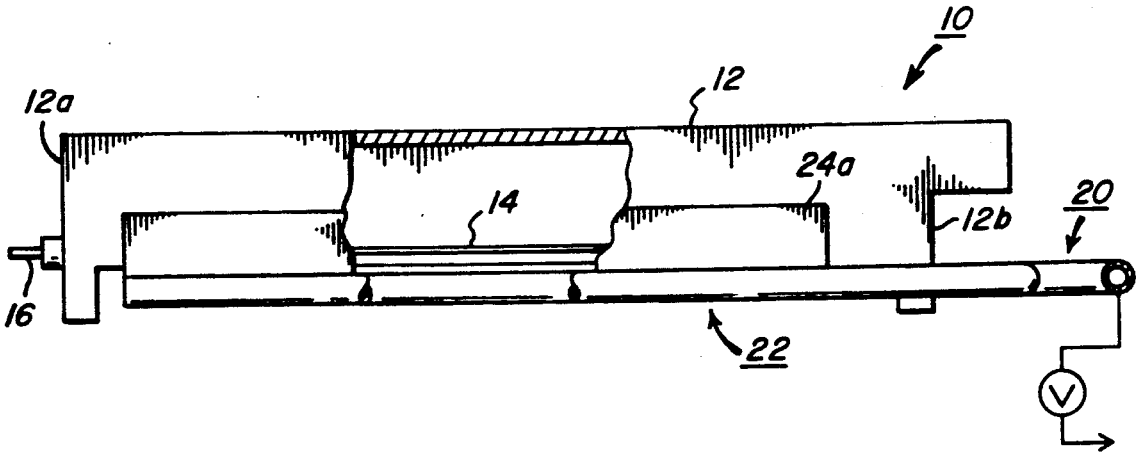
FIG. 1 is a side elevational view of a corona charger employing the device for collecting contamination products and ozone according to this invention, with portions broken away to facilitate viewing.
Figure 2:
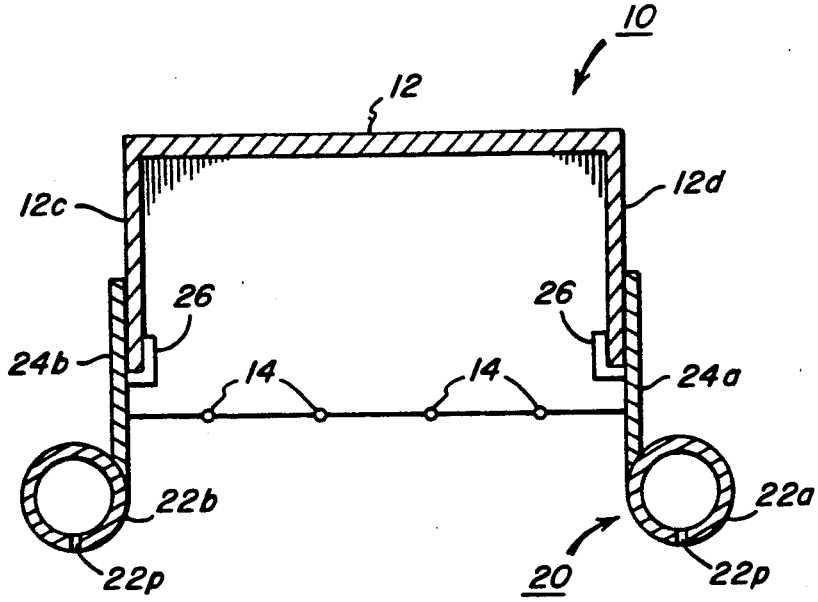
FIG. 2 is an end elevational view, in cross-section, of a corona charger employing the device for collecting contamination products and ozone according to this invention.

Referring now to the accompanying drawings, FIGS. 1 and 2 show a typical corona charger, designated generally by the numeral 10, suitable for use in enabling certain electrographic process steps to be carried out in an electrostatographic reproduction apparatus. The corona charger 10 includes an elongated shell 12 generally U-shaped in cross-section. A corona wire 14 (in the embodiment illustrated the corona wire has four strands) is strung between the ends **12*a*, 12*b* of the charger shell 12. A coupling 16 is provided in one end of the shell to connect the wire 14** to a suitable electrical potential source (not shown).

Figure 3:
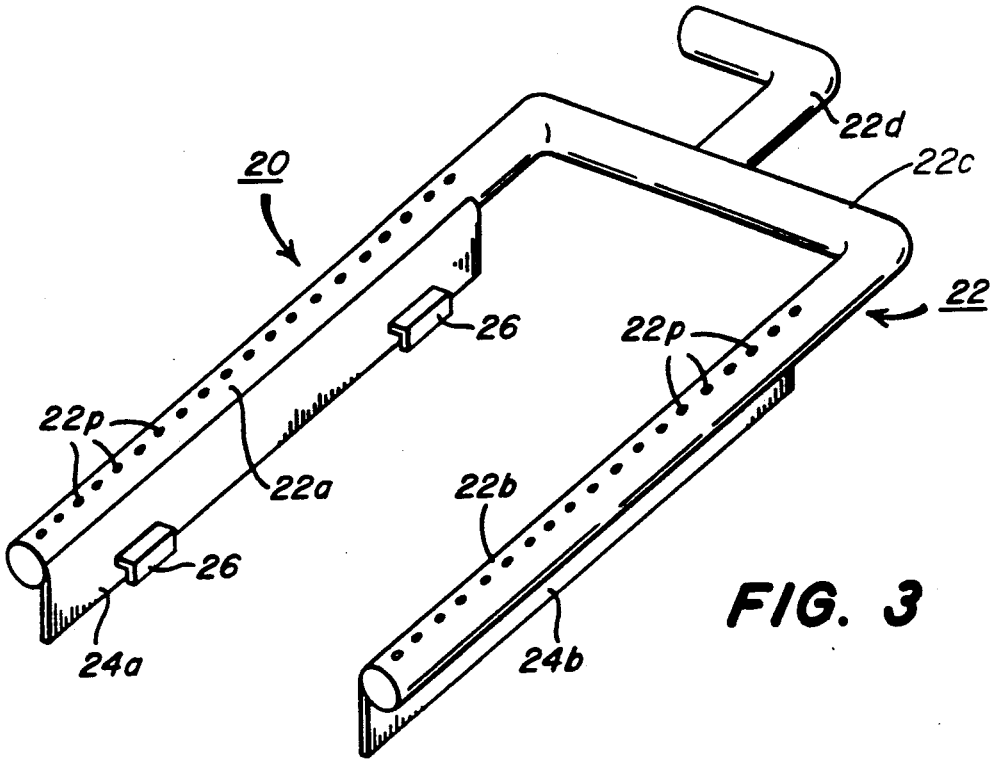
FIG. 3 is a view, in perspective from the bottom, of the device for collecting contamination products and ozone according to this invention.

The device for collecting contamination products and ozone according to this invention, designated generally by the numeral 20, is associated with the walls **12*c* and 12*d* of the shell 12 of the corona charger 10. The device 20 includes an elongated duct 22 of generally a U-shaped configuration when viewed in plan (see FIGS. 1–3). The duct 22 has a series of ports 22*p* formed in the underside of the legs 22*a*, 22*b* thereof (see FIG. 3). The ports 22*p*** are spaced at selected intervals and have particularly differing diameters for the purpose to be full explained hereinbelow.

Upstanding walls **24*a*, 24*b* are connected respectively to the legs 22*a*, 22*b* of the duct 22. The upstanding walls 24*a*, 24*b* include bent tab portions 26 adapted to receive the walls 12*c*, 12*d* of the charger shell 12 to securely locate the duct 22 relative to the charger shell. In the portion 22*c* of the duct 22 interconnecting the legs 22*a***, 22*b* thereof, there is a coupling 22*d*. The coupling 22*d* is adapted to connected in flow communication with a vacuum blower V to enable an air flow to be established, entering the ports 22*p* of the duct 22, through the duct.

Figure 4:
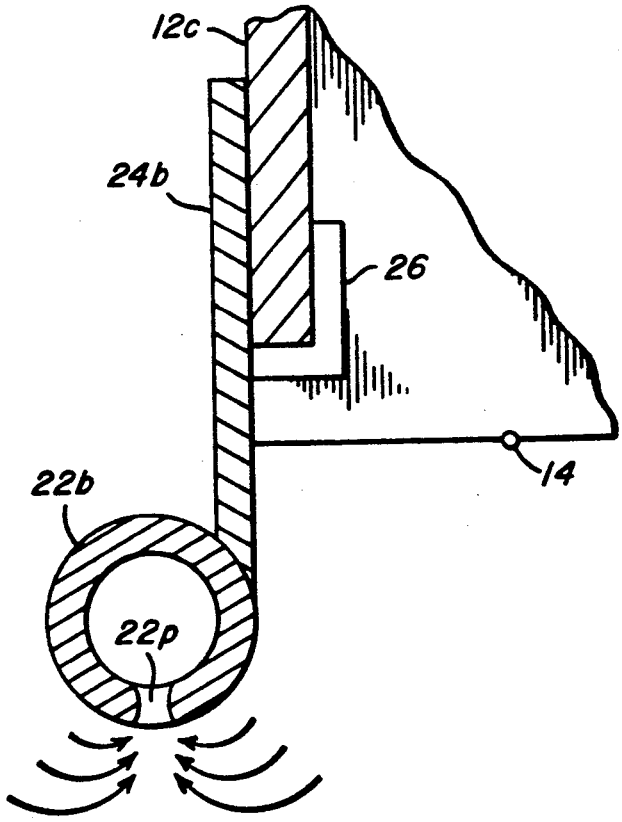
FIG. 4 is an end elevational view, in cross-section and on an enlarged scale, of a portion of the corona charger and the device for collecting contamination products and ozone, particularly showing the air flow curtain established thereby.

The air flow into the duct 22 is schematically illustrated in FIG. 4. Such air flow, forming an air curtain, is particularly established to provide a two-fold purpose. Firstly, the air flow draws harmful gasses (such as ozone and nitrogen oxides) produced by the corona charger 10 during its operation from the interior of the charger shell 12, while substantially preventing the escape thereof beyond the shell. The gasses are directly collected and fed in the air flow stream through the duct 22 to some remote location (not shown) where they can be safely reduced before being released to the atmosphere surrounding the reproduction apparatus in which the corona charger 10 is operating. This prevents the gasses from damaging the reproduction apparatus or harming the operator of such apparatus (or any other person in close proximity thereto).

The second purpose of the particularly established air flow is to entrap any contamination produces (such as, for example, toner flakes, developer particles, paper dust, or oil vapors) normally present within the reproduction apparatus. Such contamination products are also collected and fed in the air flow stream through the duct 22 to some remote location (not shown) where they can be safely removed. In this manner, the contamination products are substantially prevented from entering the interior of the charger shell 12 and kept from coming into contact with the corona wire 14 and the interior walls 12*a*–12*d* of the charger shell. Thus, contamination of the corona charger 10, and any resultant image defects in the copes being reproduced by the reproduction apparatus, is substantially prevented.

The air flow through the duct 22, necessary to carry out the desired two-fold purpose as described, must form a uniform air curtain for the corona charger 10. To enable such air curtain to be established, the ports 22*p* in the duct 22 are spaced at selected intervals and the respective diameters of the ports are of a particular dimension in order to provide air flow of sufficient velocity to accomplish the desired collection and yield a minimized practical drop in velocity of air flow from end to end of the duct to assure uniformity of the air curtain. As an illustrative example, when the vacuum blower V operates at approximately 15 cfm, the duct 22 preferably has an inside diameter of 0.375" and the length of the legs 22*a*, 22*b* are approximately 17". Then the ports 22*p* are spaced approximately 0.5" apart and have diameters in the range of approximately 0.06" to 0.09". The air flow velocity through each of the ports will then be at least 700 ft/min or greater, a velocity at which it has been determined all harmful gasses and particulate contaminates will be entrapped therein. Accordingly, the size and spacing of the ports 22*p* assures that the air curtain as a whole is uniform and of sufficient velocity along the entire length of the corona charger shell 12 to accomplish the desired collection of ozone and particulate contaminants.

The invention has been described in detail with particular reference to a preferred embodiment thereof, but it will be understood that variations and modifications can be effected within the spirit and scope of the invention.

We claim:

1. In an electrostatographic reproduction apparatus employing at least one corona charger having an elongated shell and at least one corona wire running in the longitudinal direction within the walls of said charger shell, a device for collecting contamination products and harmful gasses from said corona charger, said collection device comprising:

a duct located in association with said shell of said charger closely adjacent to the walls thereof, said duct defining a series of ports spaced along said duct in the longitudinal direction of said charger shell, said ports being of selected diameters and spaced apart at selected intervals to maintain a minimum air flow velocity at each port and minimize air flow velocity drop along said duct; and means, communicating with said duct, for providing a flow of air into said duct through said ports to directly collect harmful gasses produced by said corona charger and collect contamination products from the environment within said reproduction apparatus without being allowing such contamination products to contact and contaminate said corona wire or shell.

2. The invention of claim 1 wherein said duct is of a generally U-shaped configuration when viewed in plan, the legs of said U-shaped duct extending along said walls of said shell in the longitudinal direction.

3. The invention of claim 2 wherein air flow through each port of said duct is at least 700 ft/min.

4. The invention of claim 3 wherein said legs of said duct are approximately 17", said port diameters are in the range of approximately 0.06" to 0.09", and the spacing interval between said ports is approximately 0.5".

5. A corona charger, for use in an electrostatographic reproduction apparatus, said corona charger comprising:

an elongated shell;

at least one corona wire running in the longitudinal direction within the walls of said charger shell; and a device for collecting contamination products and harmful gasses, said device including a duct having a generally U-shaped configuration when viewed in plan, the legs of said U-shaped duct extending along said walls of said shell in the longitudinal direction, said duct defining a series of ports of selected diameters and spaced apart at selected intervals to maintain a minimum air flow velocity at each port and minimize air flow velocity drop along said duct, and means, communicating with said duct, for providing a flow of air into said duct to directly collect harmful gasses produced by said corona charger and collect contamination products from the environment within said reproduction apparatus without being allowing such contamination products to contact and contaminate said corona wire or shell.

6. The invention of claim 5 wherein air flow through each port of said duct is at least 700 ft/min.

7. The invention of claim 6 wherein said legs of said duct are approximately 17", said port diameters are in the range of approximately 0.6" to 0.09", and the spacing interval between said ports is approximately 0.5".

* * * * *